US005126578A

United States Patent [19]

Roch et al.

[11] Patent Number: 5,126,578

[45] Date of Patent: Jun. 30, 1992

[54] PROCESS AND DEVICE FOR MEASURING DISPLACEMENT RATES OF A WEB RUNNING THROUGH A MULTI-COLOR ROTARY PRINTING PRESS

[75] Inventors: Roger H. Roch, Cossonay-Ville; Patrick Monney, Villars Ste-Croix; Nathan Stern, Crissier, all of Switzerland

[73] Assignee: Bobst SA, Switzerland

[21] Appl. No.: 552,129

[22] Filed: Jul. 13, 1990

[30] Foreign Application Priority Data

Jul. 15, 1989 [CH] Switzerland ..... 2649/89

[51] Int. Cl.[5] ..... G01N 21/86

[52] U.S. Cl. ..... 250/548; 101/181

[58] Field of Search ..... 250/548, 557, 560, 561, 250/571; 356/399-401, 373, 429; 101/181, 211, 248, 486; 226/45

[56] References Cited

U.S. PATENT DOCUMENTS

| | | | |
|---|---|---|---|
| 3,559,568 | 2/1971 | Stanley | 101/181 |
| 3,653,322 | 4/1972 | Richardson | 101/248 |
| 4,025,025 | 5/1977 | Bartel et al. | 101/181 |
| 4,142,105 | 2/1979 | Erdmann | 250/548 |
| 4,243,925 | 1/1981 | Gneuchtel | 250/548 |
| 4,450,766 | 5/1984 | Inomata et al. | 101/183 |
| 4,534,288 | 8/1985 | Brovman | 101/181 |
| 4,736,680 | 4/1980 | Wales et al. | 101/181 |
| 4,926,049 | 5/1990 | Nakamura et al. | 250/548 |
| 4,948,982 | 8/1990 | Roulin | 250/548 |

FOREIGN PATENT DOCUMENTS

| | | |
|---|---|---|
| 0289206 | 11/1988 | European Pat. Off. . |
| 0317418 | 5/1989 | European Pat. Off. . |
| 1470054 | 2/1967 | France . |
| 1087484 | 10/1967 | United Kingdom . |

*Primary Examiner*—David C. Nelms
*Assistant Examiner*—S. Allen
*Attorney, Agent, or Firm*—Hill, Van Santen, Steadman & Simpson

[57] ABSTRACT

The process and the device for measuring the displacement of a web within a multi-color rotary printing press by means of a mark simultaneously printed with each color in an area free of any printing characterized by the mark passing beneath the photodetector arrangements for generating a signal. The method and the device are further characterized by the fact that the pair of photodetectors are arranged side-by-side along a crosswise line with the edges of the field for each detector arrangement being positioned above the web at the expected position for the passage of the center of the crosswise symmetrical mark and the crosswise displacement of the web is determined by the difference between the intensity variations of the signals created by each of the two photodetectors when the mark passes therethrough.

11 Claims, 1 Drawing Sheet

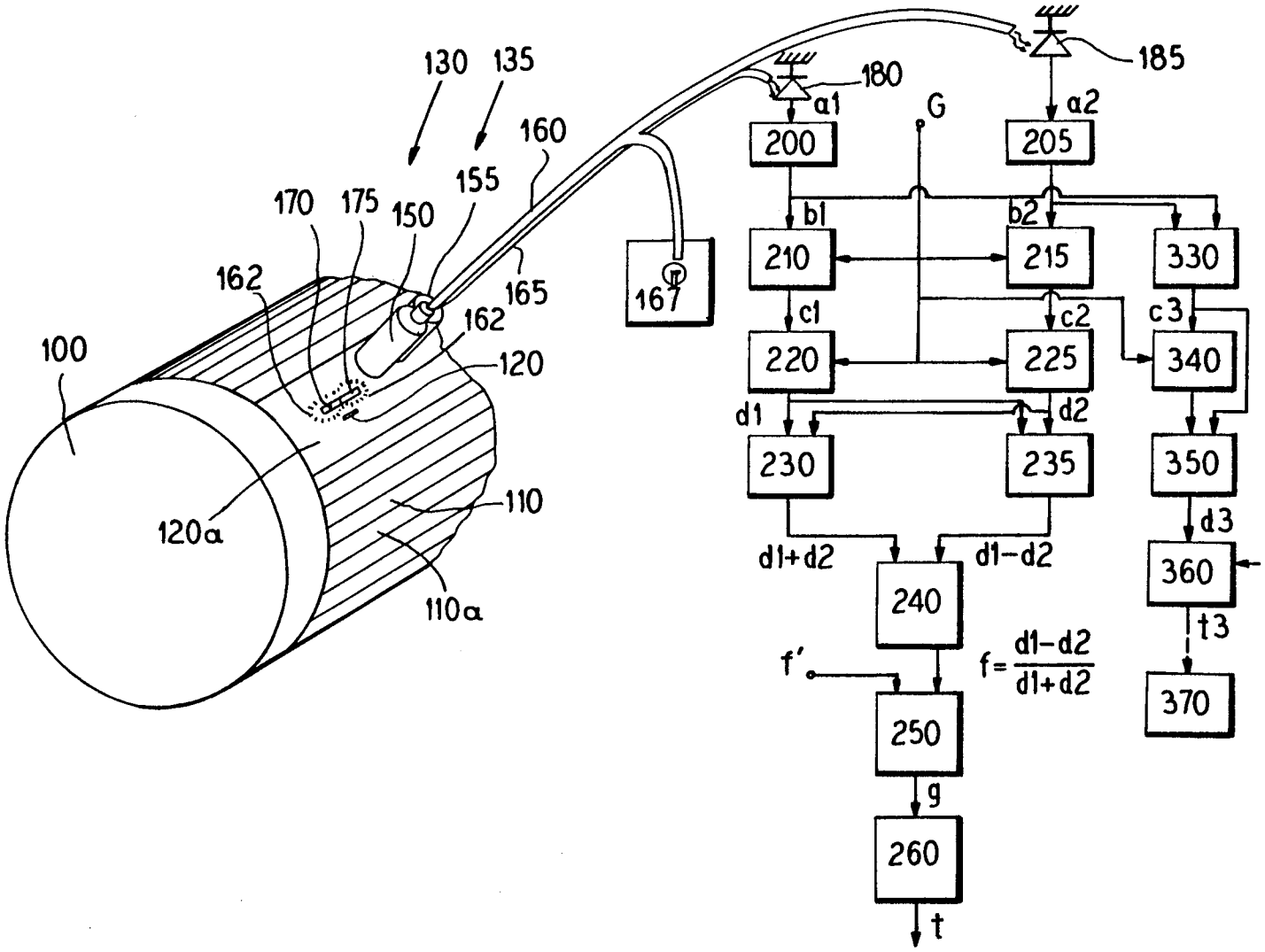
185
180
a2
a1
205
200
G
b2
b1
215
210
330
c3
340
c2
c1
225
220
350
d2
d1
235
230
d3
360
t3
370
d1−d2
d1+d2
240
f = (d1−d2)/(d1+d2)
250
f'
g
260
t
167
160
165
135
130
155
162
120
110
110a
150
175
170
162
120a
100

PROCESS AND DEVICE FOR MEASURING DISPLACEMENT RATES OF A WEB RUNNING THROUGH A MULTI-COLOR ROTARY PRINTING PRESS

BACKGROUND OF THE INVENTION

The present invention is directed to a process and a device for measuring the lengthwise and crosswise displacement of a paper or board web travelling through a rotary multi-color printing press, which device is being put into action with every color. Such a device allows a control of the required vertical and/or lateral cylinder displacement downstream with a view to insure a precise juxtaposition and registration of the successive basic color prints to produce an image.

Numerous presently known devices make use of several marks which are successively printed jointly with the various colors. These marks pass under the photoelectric detectors to cause them to generate signals with a combination allowing to determine the amplitude from the displacement value.

French Patent Document 1,470,034 describes a device having five photoelectric detectors arranged above and along a line extending crosswise to the web for scanning a mark having a shape of a line which extends crosswise to the printed web and is situated in a printless area between two prints. Operating jointly with a tachometer, the electric circuit of the device is essentially foreseen for checking whether the detectors are influenced by the characteristic mark in the center of a sufficiently broad printless area and not by other printed sections.

French Patent Document 2 362 451 discloses a device which comprises two photoelectric detectors adjacently arranged along the web travelling direction in such a way that the detection of a mark passing under these detectors may be achieved with sufficient precision. To this aim, a switching signal is emitted if the difference between the intensity of the signals read by the two detectors reaches a preset minimum value or rate. With this device, the mark dimension in the travelling direction should preferably be higher than the scanning field of the two detectors.

U.S. Pat. No. 4,450,766, whose disclosure is incorporated herein by reference thereto, describes a device for checking the multi-color juxtaposition or registration on the basis of marks with the shape of a right-angled triangle of which the two sides adjacent to the right angle extend parallel both to the travelling direction and to the webs width. A comparison of the time lag of one signal with regard to the other signal as a result from two different colors provides the value of the lengthwise displacement. A comparison of the width of the signal emitted by a detector with a reference value allows the obtaining of the value of the crosswise displacement with the corresponding color. However, a reduction of the width of such a mark in the web travelling direction will also cause a reduction of the declivity of the hypotenuse with regard to the orientation of the width which, in turn, will also considerably reduce possible variations originating from the signal width. Considering the minute error of measurement caused by the photoelectric detectors, the crosswise measurements quickly will take on a negligible value.

As has become conspicuous, the shortcomings of the abovedescribed devices is inherent in obligatorily respecting the minimal rates of the mark requested to insure proper operation and to the detriment of the area available for the print.

SUMMARY OF THE INVENTION

The purpose of the present invention is to obviate this shortcoming by proposing a process and a device for its practical application, efficacious both for measuring the lengthwise and the crosswise displacement starting from crosswise marks as small as possible, for instance less than 5 mm across with a width of 1 mm.

This purpose is obtained by a process consisting in measuring the displacement of the web travelling in a rotary multi-color printing press by means of a mark simultaneously printed with each color and supposed to run through under photoelectric detectors for generating signals with the result of the combination of which is represented for the crosswise web displacement. This process consists in positioning above the web two crosswise adjacent photoelectric detectors with their common edge of their detecting field being situated on the expected passage of the center of a crosswise symmetrical mark and determining the crosswise displacement of the web from the difference between the intensity variations of the signals spotted by each of the two photoelectric detectors when the mark travels therethrough.

For better processing, the signals created by both detectors are amplified to become signals, whose rates or values correspond to a printless area of the web, are equal to the predetermined identical rate or value before the difference has been established between the intensity variations when the mark travels therethrough. This preamplification allows a compensation for any error due to variations of the light intensity emitted by the detectors on which the more or less failing perception of the reflected light intensity is due either to a dirty receiver objective or to aging photosensitive cells.

As a rule, the crosswise displacement is determined from the proportion between the difference and the sum of the intensity variations of the signals created by each of the two detectors when the mark travels beneath the detectors. The proportion thus established allows a make-up for the mark being printed successively in various colors.

Another appropriate step of the process consists in determining the crosswise web displacement for one color from the difference between the proportions of signals established for the color and the one established for the color chosen as a reference value. This procedure allows a compensation for possible errors appearing with crosswise positioning of the photoelectric detectors from one printing unit to another.

In the line with the first feature of the device and in order to put the process into operation, the mark and the scanning field of each detector are, preferably, of a rectangular shape with almost identical dimensions, and their lengths are arranged parallel to the width of the web.

In line with the second feature of the device, a photoelectric detector includes a source of light partially absorbed by a multi-channel optical fiber before being conducted to an emitter-receiver unit situated above the web where the light is focussed to a light spot on the web with a receiver unit positioned parallel to the emitter unit and focussing the reflected light before transmitting it into another channel of the optical fiber to be conducted to a photosensitive scanning cell situated in another part of the machine.

Preferably, the device for applying the measured process for evaluating the crosswise web displacement is to include: two identical and parallel branches, each carrying a serial photoelectric detector connected to a first maximum memory circuit for establishing, memorizing and then determining from the detector's signal the value corresponding to a printless area of the web in order to generate a second signal to be applied to a second maximum memory circuit establishing and memorizing the intensity variations when a mark travels beneath the detector, both circuits of each branch being reset by a common line between the appearance of two marks, and a differentiating circuit receiving, on its first inlet terminal, the signal from the first maximum memory circuit and, on its second inlet terminal, the signal from the second maximum memory circuit.

Of each of the parallel branches, the photoelectric detector is preferably to be connected to an amplifying circuit with an automatic gain, the gain of which is balanced in such a way that the first signal received from the detector after resetting and corresponding to the printless area on the web will be amplified to a predetermined value with the output signal being applied to the inlet of the first circuit.

As an appropriate solution, the device may, moreover, include an adding circuit receiving on its inlet terminals the signals from the second maximum memory circuits, as well as a dividing circuit of which the numerator terminal is linked to the outlet of a differentiating circuit with the denominator terminal being linked to the outlet of the adding circuit.

The device may also include a differentiating circuit which receives both the output signal from the dividing circuit for the color to be checked and an output signal from a dividing circuit for a reference color.

Moreover, the signals available at the outlet of the differentiating circuit is applied to an interface circuit for transmission of the information to a distant computer.

Other advantages and features of the invention will be readily apparent from the following description of the preferred embodiments, the drawing and claims.

BRIEF DESCRIPTION OF THE DRAWING

The Figure is a perspective view of a portion of a web wrapped on a cylinder in a multi-color rotary printing press and a block diagram of the electrical components of the device for accomplishing the method in accordance with the present invention.

DESCRIPTION OF THE PREFERRED EMBODIMENTS

The illustrated way of realizing the present invention includes, mainly, analog electronic components. However, it is understood that numerous functions can also be obtained by digital electronic components used consecutively to an intermediate circuit converting the analog signal into a digital signal. The intermediate circuit can be situated either immediately at the outlet of the photodetectors or at the outlet of the subsequent processing circuits.

The principles of the present invention are particularly useful for determining the actual position of a mark 120 on a web 110 in a multi-color rotary printing press.

As illustrated in the Figure, the left-hand side shows a cylinder 100 over which a web 110 is to travel. This web has, up to this stage, been provided with successive prints 110*a* of at least one color, as well as one mark 120, in each printless area 120*a* between two prints 110*a*. According to the invention, the mark 120 should preferably have a rectangular shape with the size of about 5 mm by 1 mm and be arranged with the major length extending perpendicular to the web travelling direction or, in other words, to the lengthwise direction of the web.

Two identical photodetector means are generally indicated at 130 and 135 and are situated above the web 110 in twin positions and aligned on the expected passage of the mark 120. Every photodetector means, for instance the one designated by 130, comprises a light source 167 situated rearwardly within the machine with regard to the cylinder 100. A portion of the light emitted by the source 167 is received or collected by a first optical fiber channel system 160 and conveyed to an emitter-receiver unit 150. In a similar manner, light from the source 167 is conveyed by another fiber channel system 165 to an emitter-receiver unit 155. Both emitter-receiver units 150 and 155 are, thus, arranged above the web 100 against which they are directed in a twin-like application along the line extending transverse to the longitudinal length of the web. In other words, the emitter-receiver units 150 and 155 are positioned across the web 110 in such a way that their common edges of their fields 170, 175 will be situated on the expected passage of a center of the mark 120. The emitting appliances focus the light transmitted from the source 167 into two light spots 162. The receiving appliances are also focussed in such a way that they will scan the two fields 170 and 175 within their respective light spots 162, the fields 170, 175 have dimensions practically equal to the size of the mark 120. In view of their dimensions and particular positions, it becomes apparent that if the position of the web 110 is correct, the mark 120 will travel simultaneously through the field 170 with one of its halves and through the other field 175 with the other half. Inversely, if the web 120 is in a left-handed, offset position, the left-hand field 170 will be subjected to a stronger influence than the right-hand field 175.

It is conceivable that the shape of the mark 120 and of the scanning fields 170 and 175 might not be rectangular provided that, on the other hand, the shape be symmetrical lengthwise and crosswise and then, on the other hand, the width be adequate for effectively influencing two scanning fields simultaneously. In this way, it would be possible to take into consideration oval-shaped or lozenged marks and scanning fields.

For each photodetector, such as 130, the light reflected by the scanning field is focussed by the receiver, such as 150 or 155, before being transmitted by a second portion of the optical fiber channels 160 or 165. In this connection, various shop tests have shown that it would be appropriate to arrange the receiver units to extend parallel to the emitter unit within the case and to adjust it with an angle of approximately 80° with regard to a plane passing through the axis of the cylinder 100 with an angle of more or less 20° with regard to a plane tangent to the circumference of the cylinder 100 on the right-hand side of the scanning field as viewed in the one or the other direction.

The light transmitted in the second portion of the channel system, such as 160, is directed to a photosensitive cell 185, while the light in the second portion of the channel system 165 goes to a photosensitive cell 180. As illustrated in the right-hand side of the Figure, the principal diagram of the electronic circuits for processing the signals a1 and a2 developed by the photosensitive cells 180 and 185. The circuits with references 200-260 correspond to the processing of the crosswise or lateral displacement value of the web 110, whereas the circuits with references 330-370 correspond to the processing circuits used for detecting the lengthwise displacement.

The circuit used for processing the crosswise or lateral displacement includes two parallel and identical branches, each of which begins with a photosensitive cell, such as 180 or 185, which have the outputs al and a2, respectively. The cells 180 and 185 are connected to amplifying circuits 200 and 205, respectively, which circuits have automatic gain. The circuit has the purpose to measure the value of the first signal received for adapting its gain so that the value of the output signal b1 and b2 will be incremented to the predetermined value. In a known way, such a circuit can be set up with an operational amplifier, a negative feedback loop is integrated into a second circuit with a transistor, the emitter of which is linked to the outlet of the operational amplifier and the base of which is linked to a splitting bridge or voltage divider.

The outlets of the circuits 200 and 205 with the automatic gain are connected to second circuits 210 and 215, respectively, in which the initial value of the input signal is measured and then established in order to make up an output signal c1 and c2, which is essentially nil except for the variations becoming negative. Such a circuit is obtained by means of a first maximum memory part and a second part composed of an operational amplifier linked up by a negative feedback and acting as a subtracter. According to the state of the art, the first part of the circuit 210 and 215 can be obtained by a serial connection of a diode followed by a parallel connection with regard to the mass of a resistor and a capacitor. In this way, the compacitor will store every maximum signal appearing, since it cannot discharge itself by backfeed on account of the diode. A useful item would be the addition of a complimentary circuit for a periodic resetting, which complimentary circuit is composed of, for instance, a relay for short-circuiting the diode at the proper moment. In the second part, the signal b1 and b2 is applied to a negative terminal of an operational amplifier, whereas the signal appearing at the outlet of the first part is directed to a positive terminal. The output signal coming from the subtracter circuit may be applied to an operational amplifier, the gain of which is fitted to the unit by its negative feedback loop conferring to it a function of impedance adaptation.

The output signals c1 and c2 coming from the circuits 210 and 215, respectively, are applied to the maximum scanner circuit 220 and 225 designed for retaining, in the memory, the maximum rate d1 and d2 of the variations likely to appear until resetting will take place. These maximum scanner circuits are conventional, for example can be a circuit designated PKD 01 and sold by PMI Company.

An analog output d1, d2 originating from the two identical parallel branches are applied to an additional circuit 230 and to a subtracter circuit 235, which circuits are composed of operational amplifiers. To insure the addition process, the connection of the operational amplifier consists in directing the two input signals to the negative terminals, the positive terminal being situated on the mass and the negative feedback representing a resistor of a rate identical to the one connected serially for each input signal. To insure the subtraction, one of the signals is linked to the positive terminal by means of a half rate of a voltage divider, such as the two serial resistors of identical value, whereas the other is linked to the negative terminal, and the negative feedback represents a resistor identical to the ones connected to the negative inlet terminal, the latter being identical to the one the voltage divider is composed of.

The outlets of the subtracter circuit 235 is connected to a numerator terminal of an analog dividing circuit 240, while the output of the adding circuit is connected to a denominator terminal of the analog dividing circuit 240. Such an analog dividing circuit is known, for example it can be an AD 534, which is marketed by Société Analogue Devices. The outlet of the dividing circuit is connected to one of the terminals of a subtracter circuit 250. The other terminal is connected to the outlet of the same type of dividing circuit which belongs to a second device arranged with regard to the reference color. The result of this subtraction is applied to an electronic circuit converting an analog signal into a signal with a pulse having a width proportional to the value of the input signal. According to the state of the art, such converting circuits include a voltage ramp generator with an outlet length with the input signal to a comparator which, when positive, will subsist until the ramp will itself have obtained the same value as the input value.

As commented above, the device for measuring the crosswise displacement is to operate in the following manner:

Shortly before the passing of a printed area comes to an end, under the emitter-receiver units 150 and 155, the circuits 210, 215, 220 and 225 are reset by a common line G. The first scanning action effected by the photosensitive cells 180 and 185 will then correspond to a printless area reflecting a certain amount of light, thus calling forth the output of two signals al and a2 of, say, 400 to 800 mV. The circuits 200 and 205 will immediately adjust their gain in order to increment the output signals b1 and b2 to an identical rate, for example of 8 V. The rate of the printless area is to be scanned through the circuits 210 and 215 and then subtracted, resulting in a nil value output signal c1 and c2. The output signals d1 and d2 of the maximum measured circuit remain at the nil level.

Admitting at first that the web 110 is correctly centered, the mark 120 will pass with half of its size through the scanning field 170 and with the other half through the scanning field 175. The amount of light reflected will temporarily diminish by an identical quantity causing a temporary voltage drop of, for example, 200 mV with the signal al and a2. The signals b1 and b2, at the outlet of the automatic gain circuits 200 and 205, will put forth pulses with a value of, for example, 6 V. These pulses are transformed into negative pulses c1 and c2 with the amplitude of −2 V by the circuits 210, 215 before being memorized by the maximum scanning circuits 220 and 225. Considering the identical input intensity variation and, hence, the similarity of the levels d1 and d2, the output of the subtracter circuit 235 remains nil, the proportion $f = (d1 - d2)/(d1 + d2)$ equally remaining nil. This means that the web 110 has been found correctly centered, which fact, if consideration is given to the complimentary signal f' added, is transmitted by a signal g from the outlet of the circuit 250 and then by a signal t from the outlet of the converting circuit 260, the width of which will correspond to a nil or zero value centering error.

If the web 110 is displaced, for example, to the left-hand side, the scanning field 170 will be more influenced than the scanning field 175. In other words, the variation of the signal a2 appearing at the outlet of the photoelectric cell 185 will be greater than the variation of the signal al of the photoelectric cell 180. This difference can be noticed at the outlet of the subtracter circuit 235, the outlet of the addition circuit 230 shaping the total variation due to the whole of the mark 120. This total variation depends itself on the color of the mark, with a yellow color causing a considerably smaller total variation than a dark color, for example red. However, when put back to the total variation caused by the color mark, the signal f equalling the variation proportion in crosswise direction, is conspicuous for the web displacement independent of the particular color being processed.

The proportion signal f is actually usable only if it is admitted that when the printing action is launched, all printing plates are arranged with precision on their cylinders and that the emitter-receiver pairs are arranged accurately above their respective cylinders. Considering the difficulties encountered for realizing the above-mentioned conditions, an easier way consists in admitting a color as a reference value and in comparing the reference color for each displacement spotted with regard to the color mark being scanned. This function is insured by the subtracter 250, in which the signal f' corresponding to the reference color error or signal is compared to the signal f of the mark being checked.

The device used for measuring the lengthwise or longitudinal displacement of the web 110 includes a serial addition circuit 330 receiving signals a1, a2 directly from the photocells or, preferably, as illustrated, receiving the automatic gain amplification signals b1 and b2 from the amplifiers 200 and 205, respectively. The outlet of the above-mentioned addition circuit 330 is connected, on the one hand, to a circuit 340 thus establishing and then memorizing the rate corresponding to a printless area of the web and, on the other hand, to a differentiating circuit 350, the second inlet terminal of which is linked to the outlet of the above-mentioned circuit 340. The outlet of the differentiating circuit 350 is connected to a comparing circuit 360, which has another terminal of which is to receive an adjustable reference signal. The output signal t3 from the comparator circuit 360 is transmitted to a computer 370 which may be arranged elsewhere on the machine.

The circuit, as described, operates in the following way:

The computing circuit 330 collects the data originating from all emitter-receivers 150 and 155 arranged crosswise in such a way that, for this measurement, the upstream part of the device is equivalent to a single photoelectric detector scanning the mark 120. After a resetting by the line G, the circuit 340 scans and memorizes the rate of the signal corresponding to a printless area. This rate is to be subtracted from the input signal c3 by the circuit 350 so that the output signal d3 will generally be nil or zero, except for a negative pulse corresponding to the passing of the mark 120. In other words, the circuits 340 and 350 put together are equivalent to each of the circuits 210 and 215 described above. The comparator 360 has the purpose to filter out the background noise so that the output signal t3 will form a perfect pulse. The computer 370 is to reshape a signal in such a way as if it would be produced in the middle of the pulse, which action allows to cause the signal to be emitted accurately and regularly with regard to the detection of the mark 120, whatever its width, or the erroneous scanning by the receiver units 150 and 155.

As could be noticed, the joint action of the process and the device according to the invention allows for obtaining a precise measurement, both with lengthwise and crosswise displacement on the basis of a mark, the width of which can be considerably reduced.

Numerous improvements may be added to the device within the limits of this invention. So, for instance, the diagram of the circuit used for processing the signal originating from the photodetectors may include, at its inlet, an analog and digital converting circuit, the subsequent processing circuits being then made of digital electrical components.

Although various minor modifications may be suggested by those versed in the art, it should be understood that we wish to embody within the scope of the patent granted hereon all such modifications as reasonably and properly come within the scope of our contribution to the art.

What is claimed is:

1. In a process for measuring the displacement rate of a web within a multi-color rotary printing press by means of a mark simultaneously printed with each color, said process including passing the mark under photoelectric detectors for generating signals, and combining said signals to provide a crosswise web displacement, the improvements comprising arranging two photodetectors to extend adjacent each other on a line extending crosswise to the length of the web, said detectors being arranged with a common edge between their fields of view being the expected center of the crosswise symmetrical mark, amplifying the signals created by the two detectors in a printless area of the web to be equal to a predetermined identical value before the difference has been determined between the intensity variations when the mark passes beneath said detectors, and determining the crosswise displacement of the web from a difference between the intensity variation of the signals created by each of the two photoelectric detectors when the mark passes therebeneath.

2. In a process according to claim 1, wherein the step of determining the crosswise displacement of the web includes forming a proportion between the difference of the two signals divided by the sum of the two signals created when the mark passes beneath said detectors.

3. In a process according to claim 2, wherein the step of determining the crosswise displacement of the web includes comparing the proportion created from the mark being passed beneath the detectors to a reference proportion to obtain an error signal corresponding to the crosswise offset.

4. In a process for measuring the displacement rate of a web within a multi-color rotary printing press by means of a mark simultaneously printed with each color, said process including passing the mark under photoelectric detectors for generating signals, and combining said signals to provide a crosswise web displacement, the improvements comprising arranging two photodetectors to extend adjacent each other on a line extending crosswise to the length of the web, said detectors being arranged with a common edge between their fields of view being the expected center of the crosswise symmetrical mark, and determining the crosswise displacement of the web from a difference between the intensity variation of the signals created by each of the two photoelectric detectors when the mark passes therebeneath, said step of determining the crosswise displacement of the web including forming a proportion between the differences of the two signals over the sum of the two signals created by the detector when a mark passes therebeneath.

5. In a process according to claim 4, wherein the step of determining the error signal includes comparing the proportion between the difference of the two measured signals and the sum of the two different signals with a reference proportion to obtain an error signal for the amount of crosswise displacement.

6. A device for determining the displacement rate of a web within a multi-color rotary printing press by means of a mark simultaneously printed with each color between each area of print, said device including a pair of photoelectric detectors being positioned above the web with their scanning field being substantially rectangular and lying on a line extending transverse to the direction of movement of the web, each of said rectangular fields being identical in dimensions with the shape of the mark with the fields being positioned side-by-side on the expected center of the crosswise symmetrical mark, each of the photodetector means including a light source partially absorbed by an optical multi-channel fiber system transmitting the light from the source to an emitter-receiver unit situated above the web, and light being focussed so as to form a light spot on the web, the receiver unit being positioned relative to the emitter unit for focussing the reflected light back into an optical channel of the optical fiber system to be conducted to a detecting photosensitive cell positioned away from the web, and means for determining the difference between the intensity variations of the signals created by each of the two photodetectors when the mark travels therethrough.

7. A device for measuring the displacement of a web within a multi-color rotary printing press by means of a crosswise mark which is simultaneously printed with each color between the color portions, said device including photodetecting means for generating signals being positioned above the web along a crosswise extending line with the scanning field of each detector being situated side-by-side with the expected passage of the center of the crosswise mark passing therebeneath, and means for determining the crosswise displacement of the web from the difference between the intensity variations of the signals created by the pair of photodetector means when the mark passes therethrough, said means for detecting including two identical parallel branches, each having an output of the photoelectric detector means connected to a first maximum memory circuit means for establishing, memorizing and determining from the detector signal a value corresponding to the printless area of the web in order to generate a second signal to be applied to a second maximum memory circuit means establishing and memorizing the intensity variation when the mark travels beneath the photodetecting means, means for resetting each of said circuit means by a common line between the appearance of two successive marks and a differentiating circuit receiving, on its first inlet terminal, a signal from the first maximum memory circuit means and on a second inlet terminal, a signal from the second maximum memory means.

8. A device according to claim 7, wherein each of the parallel branches of the photoelectric detector is connected to an amplifying circuit with an automatic gain, said gain being balanced in such a way that a first signal received from the detector after resetting and corresponding to a printless area of the web will be amplified to a predetermined value with the output signal being applied to the inlet of the first circuit means.

9. A device according to claim 8, wherein one of the branches includes an adding circuit means for receiving on inlet terminals the signals from the second maximum memory circuits of each branch, as well as the other branch having a differentiating circuit means for receiving the signals from the second maximum memory circuit means, said device including dividing circuit means having a numerator terminal receiving the output of the differentiating circuit means and a denominator terminal being linked to the outlet of the adding circuit means.

10. A device according to claim 9, which includes a second differentiating circuit means receiving both an output from the dividing circuit means and receiving a reference signal for comparison to the output signal of the dividing circuit means.

11. A device according to claim 11, wherein the second differentiating circuit produces an error circuit and includes an interface circuit for transmitting the error circuit of the differentiating means for further processing.

* * * * *